US006763870B2

(12) United States Patent
Spatafora et al.

(10) Patent No.: US 6,763,870 B2
(45) Date of Patent: Jul. 20, 2004

(54) METHOD AND UNIT FOR APPLYING LABELS

(75) Inventors: Mario Spatafora, Bologna (IT); Fabrizio Tale', Bologna (IT)

(73) Assignee: G.D Societa' Per Azioni, Bologna (IT)

( * ) Notice: Subject to any disclaimer, the term of this patent is extended or adjusted under 35 U.S.C. 154(b) by 252 days.

(21) Appl. No.: 09/946,155

(22) Filed: Sep. 4, 2001

(65) Prior Publication Data

US 2002/0046801 A1 Apr. 25, 2002

(30) Foreign Application Priority Data

Sep. 7, 2000 (IT) ..... BO2000A0517

(51) Int. Cl.[7] ..... B65C 1/06; B65C 1/04; B65C 9/10

(52) U.S. Cl. ..... 156/483; 156/492; 156/212; 156/556; 156/566; 156/571; 156/572; 156/DIG. 4; 53/136.4; 53/415

(58) Field of Search ..... 156/DIG. 1, DIG. 2, 156/DIG. 3, 556, 566, 571, 572, 482, 492, 486, 483, 484, 485, 477.1, 479, 196, 212; 53/415, 416, 136.1, 136.4

(56) References Cited

U.S. PATENT DOCUMENTS

| | | | | | |
|---|---|---|---|---|---|
| 1,261,595 | A | * | 4/1918 | Mulet | 156/486 |
| 1,693,965 | A | | 12/1928 | Smith et al. | |
| 1,939,507 | A | * | 12/1933 | Mason | 156/482 |
| 4,086,744 | A | * | 5/1978 | Seragnoli | 53/136.4 |
| 4,181,561 | A | * | 1/1980 | Seragnoli | 156/566 |
| 4,564,412 | A | * | 1/1986 | Oberdorf | 156/484 |
| 5,111,633 | A | * | 5/1992 | Draghetti | 53/136.1 |
| 5,203,953 | A | * | 4/1993 | Focke et al. | 156/566 |
| 5,645,669 | A | | 7/1997 | Crankshaw et al. | 156/212 |
| 6,105,340 | A | * | 8/2000 | Draghetti | 53/415 |

* cited by examiner

*Primary Examiner*—Sue A. Purvis
(74) *Attorney, Agent, or Firm*—Ladas & Parry

(57) ABSTRACT

A method and unit for applying labels to packets of cigarettes, traveling in a given direction along a first path with a given spacing and arranged a given distance apart, provide for feeding a gripping head along a second path, and applying each label to a first face of a respective packet by inserting the gripping head between one packet and the adjacent following packet to roll the gripping head and apply the label along the first face, which is perpendicular to the given direction. (FIG. 1)

31 Claims, 3 Drawing Sheets

METHOD AND UNIT FOR APPLYING LABELS

The present invention relates to a method of applying labels.

More specifically, the present invention relates to a method of applying labels to packets of cigarettes, to which the following description refers purely by way of example.

BACKGROUND OF THE INVENTION

Known methods of applying labels to packets of cigarettes comprise feeding the packets of cigarettes in a given direction along a first path; withdrawing the labels by means of a gripping head from the outlet of a store; feeding the gripping head and relative label along a given second path; and applying each label to a respective packet, on a face parallel to the traveling direction of the packet.

When the label is also folded onto further faces of the packet, units implementing the above methods require a movable folding device for each free portion of the label; and the above methods must also ensure each packet and the gripping head by which the label is applied to the packet are fed at the same speed along parallel portions of the respective paths to prevent relative slippage of the packet and label and so ensure precise application of the label.

Controlling the two feed speeds, however, is extremely difficult, particularly when a high degree of precision is required.

The accuracy with which the label is applied is extremely important in the case of revenue stamps applied to hinged-lid packets of cigarettes and having tear lines.

Hinged-lid packets of cigarettes comprise a cup-shaped body and a lid separated from the cup-shaped body by a parting line; and labels with tear lines must be applied extremely accurately so that the tear line corresponds to the parting line. Otherwise, the tear line remains intact, and therefore serves no purpose, when the packet is unsealed.

SUMMARY OF THE INVENTION

It is an object of the present invention to provide a method of applying labels, designed to eliminate the drawbacks of known methods.

According to the present invention, there is provided a method of applying labels to packets, in particular packets of cigarettes, traveling in a given direction along a first path with a given spacing and arranged a given distance apart; the method comprising feeding a gripping head along a second path, and applying a said label to a first face of said packet; and the method being characterized by inserting said gripping head between one packet and the adjacent following packet to apply said label along said first face; said first face being perpendicular to said given direction.

The present invention also relates to a unit for applying labels.

According to the present invention, there is provided a unit for applying labels to packets, in particular packets of cigarettes, traveling in a given direction along a first path with a given spacing and arranged a given distance apart; the packets having respective first faces perpendicular to said given direction; the unit comprising at least one gripping head movable along a second path to apply a said label to a respective packet; and the unit being characterized by comprising at least one movable arm for inserting said gripping head between one packet and the adjacent following packet to apply said label along said first face.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
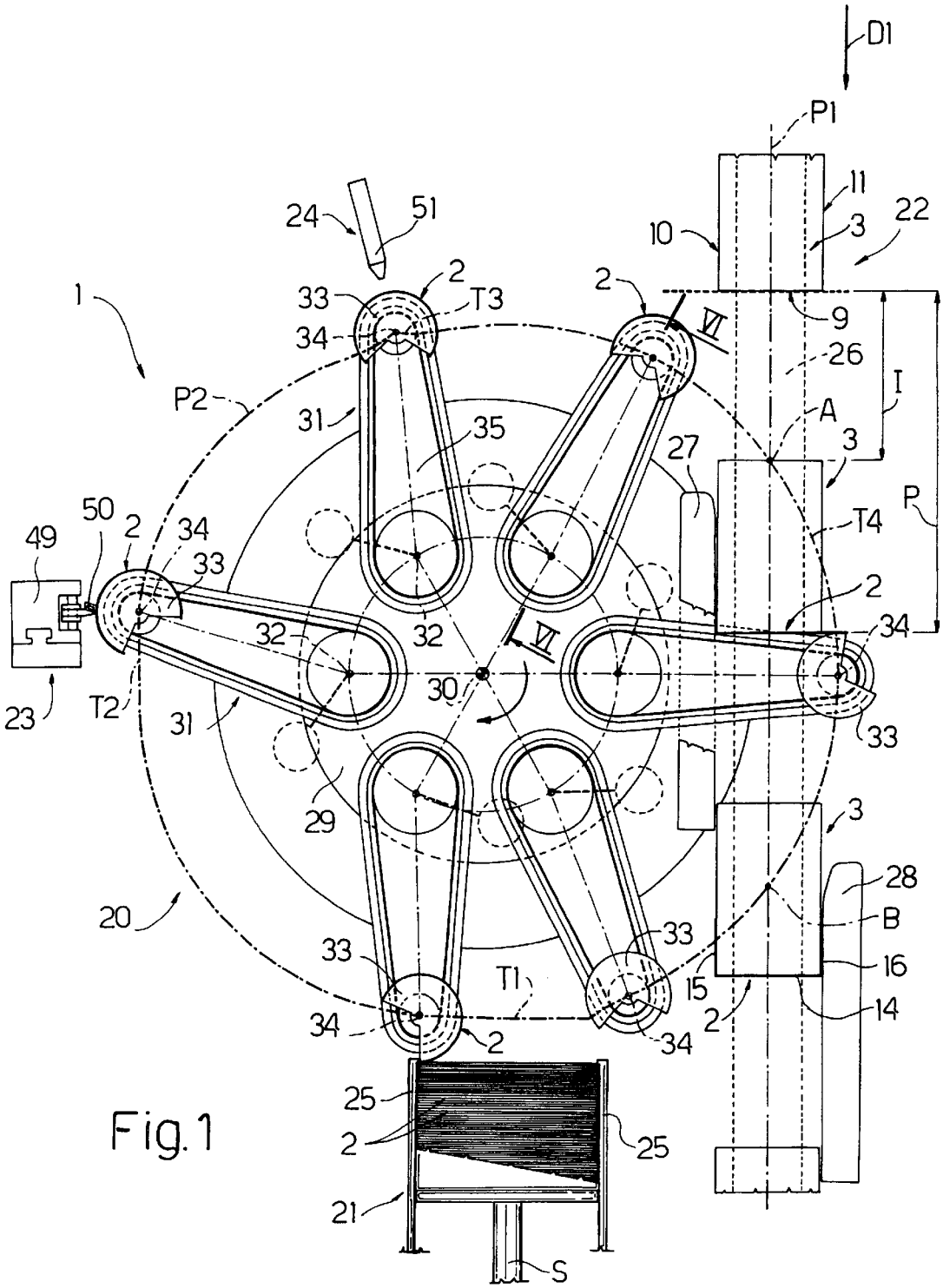
FIG. 1 shows a plan view, with parts removed for clarity, of a unit for applying labels in accordance with the present invention.

Number 1 in FIG. 1 indicates as a whole a unit for applying labels 2 to packets 3 of cigarettes traveling continuously along a path P1 extending in a direction D1.

Figure 2:
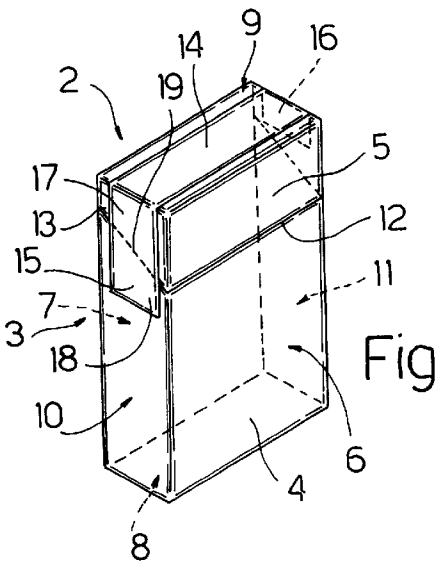
FIG. 2 shows a view in perspective of a packet bearing a label applied using the method according to the present invention.

As shown more clearly in FIG. 2, packets 3 are rigid hinged-lid types. Each packet 3 comprises a cup-shaped body 4 and a lid 5, and, once label 2 is applied, has a label 2 applied partly to lid 5 and partly to cup-shaped body 4. When lid 5 is in the closed position, packet 3 has a front face 6, a rear face 7, a bottom face 8, a top face 9, and two lateral faces 10 and 11. Lid 5 and cup-shaped body 4 are hinged along rear face 7 and are separated by a parting line 12 along front face 6 and by two parting lines 13 along respective lateral faces 10 and 11. Label 2 has a central portion 14 adhering to top face 9; an end portion 15 adhering to lateral face 10; and an end portion 16 adhering to lateral face 11. Central portion 14 and portion 16 adhere solely to lid 5, whereas portion 15 adheres partly to lid 5 and partly to cup-shaped body 4. Portion 15 is in turn divided into two parts 17 and 18 by a tear line 19 extending along parting line 13 along wall 10.

With reference to FIG. 1, unit 1 comprises a transfer wheel 20; a store 21 of labels 2; a conveyor 22 for packets 3; a cutting device 23; and a gumming device 24.

Store 21 comprises guides 25 for maintaining labels 2 in a pack and for guiding each label 2 to an outlet of store 21 in a given pickup position in which label 2 lies and is maintained by two teeth of guides 25 in a vertical plane.

The store comprises a pusher S for feeding the pack of labels 2 towards the outlet.

Conveyor 22 comprises a support 26, shown by the dash lines in FIG. 1, on which packets 3 are equally spaced with top faces 9 perpendicular to direction D1 and front faces 6 facing support 26. Along path P1 of conveyor 22, two fixed folding devices 27 and 28 are provided on opposite sides of conveyor 22 so as to contact respective lateral faces 10 and 11 of each packet 3.

Wheel 20 comprises a central hub 29 rotating continuously clockwise, in FIG. 1, about a respective vertical axis 30; and a number of arms 31 rotating, with respect to hub 29, about respective axes 32 parallel to and equally spaced about axis 30. Each arm 31 is fitted on the end with a gripping head 33, which rotates about an axis 34 parallel to axis 30 and is fed along a path P2.

Figure 6:
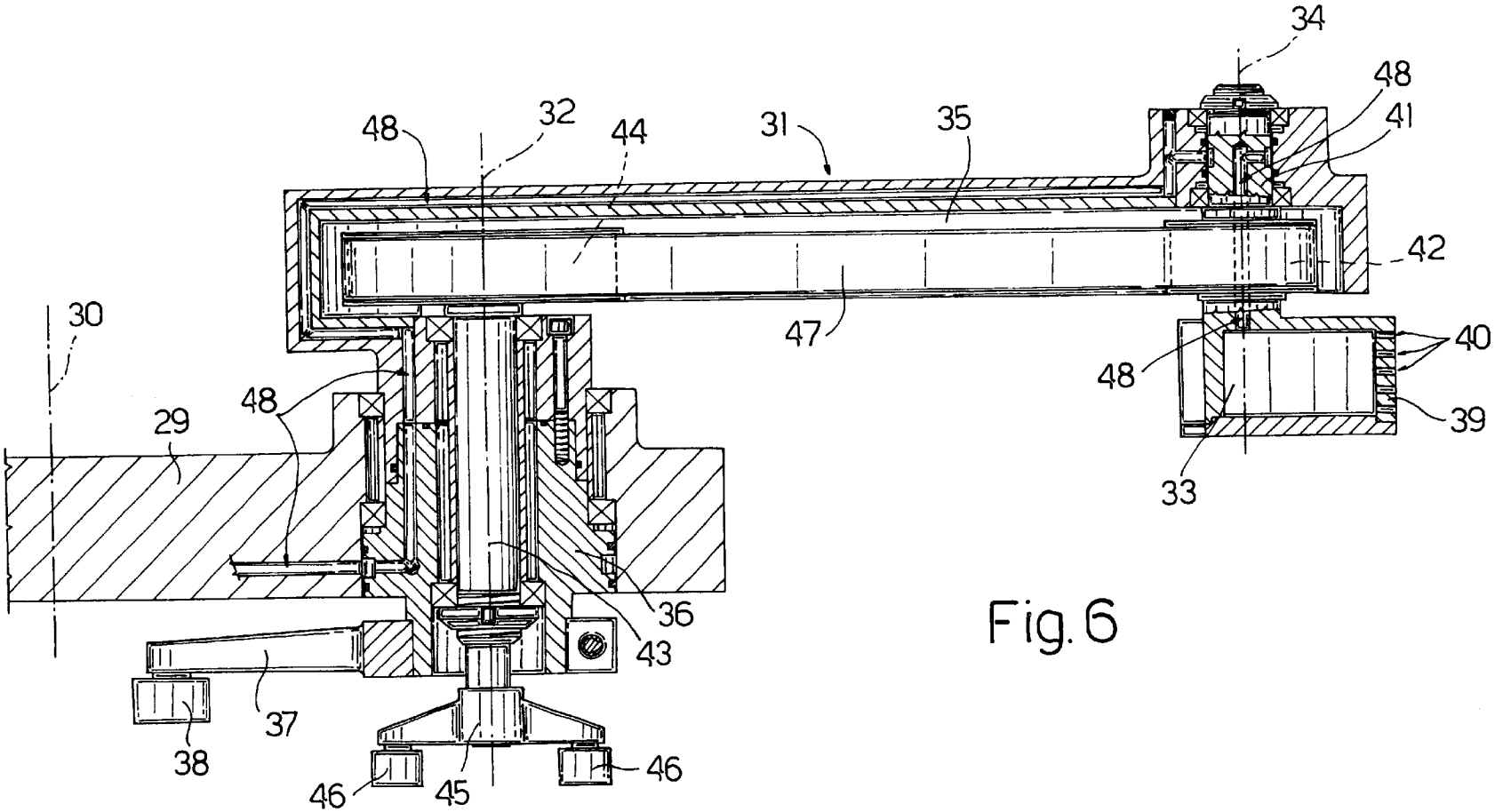
FIG. 6 shows a section of a detail of the FIG. 1 unit along line VI—VI.

With reference to FIG. 6, each arm 31 comprises a hollow body 35 integral with a sleeve 36, which rotates about axis 32 and is integral with a lever 37 having a roller 38 which engages a cam (not shown) to position arm 31 according to the angular position assumed by axis 32 of respective arm 31 about axis 30.

Gripping head 33 has a gripping wall 39 in the form of a cylindrical sector extending about axis 34, and which has a number of suction holes 40 for retaining label 2 on gripping wall 39. Gripping head 33 is integral with a shaft 41 mounted for rotation about axis 34 and in turn integral with a pulley 42. Sleeve 36 is fitted inside with a shaft 43, which rotates about axis 32 and is fitted, on the top end, with a pulley 44 larger in diameter than pulley 42, and, on the bottom end, with a rocker arm 45 having two rollers 46 which engage respective cams (not shown) for rotating pulley 44 about axis 32 according to the angular position assumed by axis 32 about axis 30. A belt 47 is looped about pulleys 44 and 42 to transmit rotation from pulley 44 to pulley 42; and a suction channel 48 is formed inside hub 29, sleeve 36, hollow body 35, shaft 41 and gripping head 33 to selectively activate suction holes 40.

With reference to FIG. 1, cutting device 23 comprises a supporting member 49 supporting a blade 50 in a fixed position with respect to path P2; and gumming device 24 comprises a gumming spray nozzle 51 also in a fixed position along path P2.

In actual use, unit 1 for applying labels 2 feeds packets 3 along path P1 in direction D1, with top faces 9 perpendicular to and at the front with respect to traveling direction D1, and with packets 3 equally spaced along support 26 with a given spacing P and a gap I between each packet 3 and the adjacent following packet 3.

Hub 29 is rotated continuously about axis 30, arms 31 are oriented about axes 32 according to the angular position assumed by axes 32 about axis 30, and gripping heads 33 are rotated about axes 34 also according to the angular position assumed by axes 32 about axis 30. Each gripping head 33 is fed along endless path P2, which intersects path P1 at two points A and B; and, along path P2, each gripping head 33 travels past store 21, cutting device 23 and gumming device 24.

As gripping head 33 nears store 21, arm 31 is rotated clockwise about axis 32 so that gripping wall 39 contacts the label 2 in the pickup position inside store 21.

Once wall 39 contacts label 2, arm 31 is rotated anticlockwise in FIG. 1, so that the combined rotations about axis 30 and axis 32 arrest gripping head 33 at the point of contact between wall 39 and label 2. And, while gripping head 33 is stationary, suction holes 40 are activated, and gripping head 33 then moved along a straight portion T1 of path P2.

Figure 3:
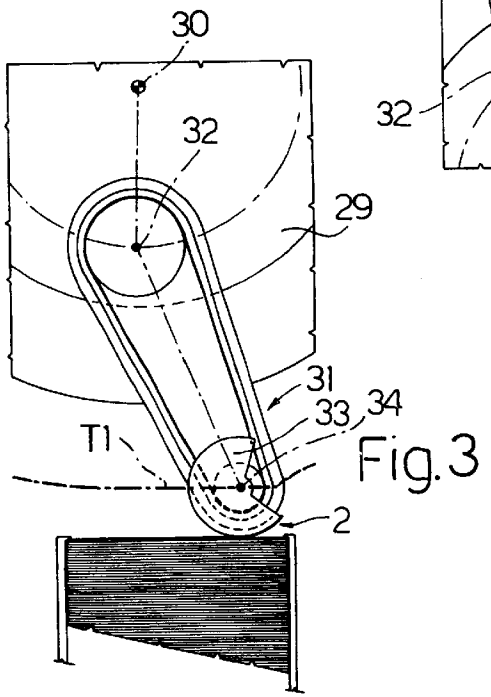

As shown more clearly in FIG. 3, along portion T1, the suction through holes 40 is maintained, and gripping head 33 is rotated about axis 34 by rocker arm 45 and the mechanical transmission defined by pulleys 42 and 44 and belt 47, which transmits rotation to gripping head 33. As gripping head 33 rotates about axis 34 and is moved along straight portion T1, gripping wall 39 rolls along label 2, which, by virtue of the suction through holes 40, adheres to gripping wall 39 and is gradually withdrawn from the outlet of store 21.

Figure 4:
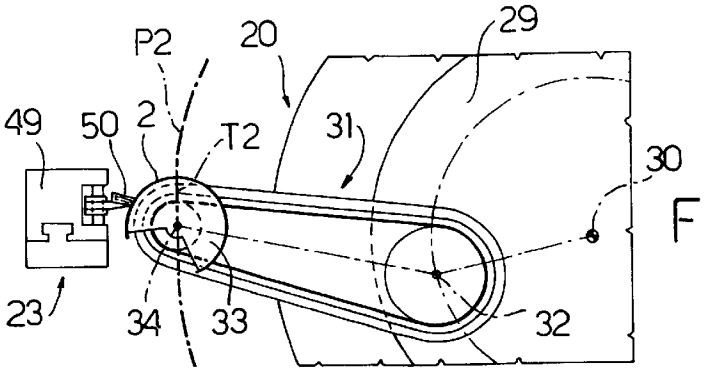

Gripping head 33 is then fed, together with label 2, along a straight portion T2 of path P2 past cutting device 23, as shown more clearly in FIG. 4, and is rotated about axis 34 so that label 2 contacts fixed blade 50 to form tear line 19.

With reference to FIG. 1, at gumming device 24, arm 31 is first rotated clockwise in FIG. 1 and then anticlockwise to form a pointed portion T3 of path P2; and gripping head 33 is rotated about axis 34 along portion T3 to position the whole surface of label 2 in front of nozzle 51 which gums label 2.

Figure 5:
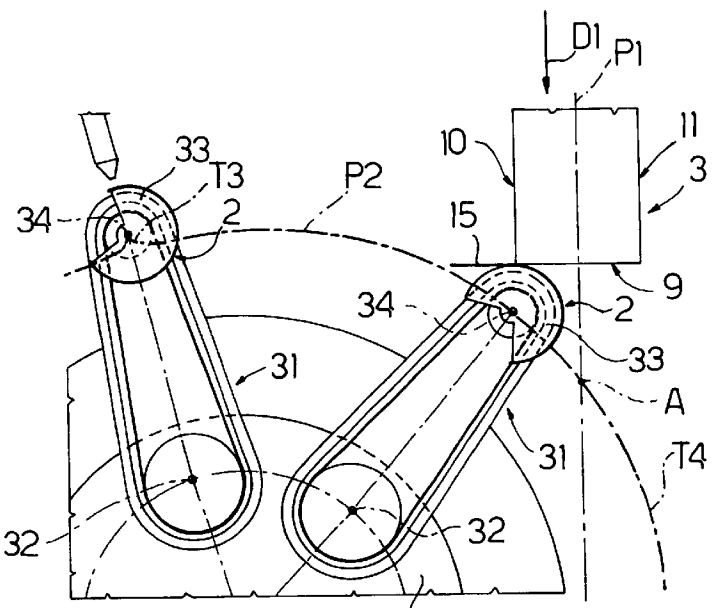
FIGS. 3 to 5 show plan views, with parts removed for clarity, of details of the FIG. 1 unit at successive steps in the method according to the present invention.

Gripping head 33 is then fed along a portion T4, along which gripping head 33 is positioned inside the gap I between one packet 3 and the adjacent following packet 3, and wall 39 is brought into contact with and rolled along top face 9 of the following packet 3. In other words, with reference to FIG. 5, gripping head 33 and respective label 2 are brought into a position of interference with respect to a packet 3 traveling in direction D1, and in which label 2 is brought into contact with top face 9 of packet 3. At this stage, suction holes 40 are deactivated, and wall 39 rolls along top face 9 to lay label 2 gradually on top face 9.

Portion 15 projects with respect to lateral face 10 and is folded onto face 10 by fixed folding device 27. In the meantime, gripping head 33 lays the whole of central portion 14 of label 2 on top face 9 so that portion 16 projects with respect to lateral face 11; and gripping head 33 is then fed along path P2 between fixed folding devices 27 and 28, and packet 3 is brought into contact with fixed folding device 28 to fold portion 16 onto lateral face 11.

The present invention is particularly advantageous by preventing relative slippage of the packet and label as the label is applied, thus ensuring a high degree of precision; by enabling the free portions to be folded by fixed folding devices; and by the highly maneuverable gripping head greatly simplifying the cutting and gumming devices.

What is claimed is:

1. A method of applying labels to packets, in particular packets of cigarettes, traveling in a given direction (D1) along a first path (P1) with a given spacing (P) and arranged a given distance (I) apart; the method comprising feeding a gripping head (33) along a second path (P2), applying a said label (2) to a first face (9) of said packet (3) and inserting said gripping head (33) between one packet (3) and the adjacent following packet (3) to apply said label (2) along said first face (9); said first face (9) being perpendicular to said given direction (D1); said gripping head comprising a gripping wall (39) in the form of a cylindrical sector, having suction holes (40), and rotating about a first, a second and a third axis (30, 32, 34) parallel to one another and to said gripping wall (39).

2. A method as claimed in claim 1, wherein said label (2) comprises a central portion (14) which is positioned contacting said first face (9); and at least a first portion (15) which is positioned contacting a second face (10) of the packet (3); said second face (10) being parallel to said given direction (D1); and the method providing for folding said first portion (15) by means of a fixed first folding device (27) located along the first path (P1).

3. A method as claimed in claim 2, wherein said label (2) comprises a second portion (16) which is positioned contacting a third face (11) of the packet (3); said third face (11) being parallel to said given direction (D1); and the method providing for folding said second portion (16) by means of a fixed second folding device (28) located along the first path (P1).

4. A method as claimed in claim 1, and comprising rolling the gripping head (33) on said first face (9).

5. A method as claimed in claim 1, and comprising feeding said gripping head (33) along a straight first portion (T1) of the second path (P2), and rolling said gripping wall (39) on a label (2) located at an output of a store (21) of labels (2).

6. A method as claimed in claim 5, wherein said gripping head (33) is stopped at a point along the straight said first portion (T1); said suction holes (40) being activated at said stop point of the gripping head (33) when said gripping wall (39) contacts a label (2).

7. A method as claimed in claim 5, wherein said gripping head (33) along a straight second portion (T2) of the second path (P2), the straight said second portion (T2) being located opposite a fixed blade (50); and by rotating said gripping head (33) about said third axis (34) to bring different parts of the label (2) into contact with the fixed blade (50) and form a tear line (19) on said label (2).

8. A method as claimed in claim 5, and comprising feeding said gripping head (33) along a third portion (T3) of the second path (P2), and rotating the gripping head (33) about the third axis (34) along the third portion (T3); said third portion (T3) being pointed and located opposite a gumming spray nozzle (51) for gumming the label (2) retained by the gripping wall (39).

9. A method as claimed in claim 1, wherein said first, said second and said third axis (30, 32, 34) are vertical.

10. A method as claimed in claim 1, wherein said second path (P2) is an annular path intersecting the first path (P1) at two points (A, B).

11. A unit for applying labels to packets, in particular packets of cigarettes, traveling in a given direction (D1) along a first path (P1) with a given spacing (P) and arranged a given distance (I) apart; the packets (3) having respective first faces (9) perpendicular to said given direction (D1); the unit comprising at least one gripping head (33) movable along a second path (P2) to apply a said label (2) to a respective packet (3); and at least one movable arm (31) for inserting said gripping head (33) between one packet (3) and the adjacent following packet (3) to apply said label (2) along said first face (9); said gripping head (33) comprising a gripping wall (39) in the form of a cylindrical sector, having suction holes (40), and rotating about a first, a second and a third axis (30, 32, 34) parallel to one another and to said gripping wall (39).

12. A unit as claimed in claim 11, wherein said label (2) comprises a central portion (14) which adheres to said first face (9); and at least a first portion (15) which adheres to a second face (10) of the packet (3); said second face (10) being parallel to said given direction (D1); and the unit comprising a fixed first folding device (27) located along said first path (P1) to fold said first portion (15) onto the second face (10).

13. A unit as claimed in claim 12, wherein said label (2) comprises a second portion (16) opposite the first portion (15); the second portion (16) adhering to a third face (11) parallel to the second face (10); and the unit comprising a fixed second folding device (28) located along said first path (P1) to fold said second portion (16) onto said third face (11).

14. A unit as claimed in claims 13, wherein said second folding device (28) is located downstream from said first folding device (27).

15. A unit as claimed in claim 11, and comprising a wheel (20) in turn comprising a hub (29) rotating about said first axis (30); said arm (31) rotating with respect to said hub (29) about the second axis (32); said gripping head (33) rotating about said third axis (34) with respect to the arm (31); and said gripping wall (39) extending about said third axis (34).

16. A unit as claimed in claim 11, and comprising a mechanical transmission (42, 44, 47) housed in said arm (31) to rotate said gripping head (33) about said third axis (34).

17. A unit as claimed in claim 16, wherein said mechanical transmission (42, 44, 47) comprises a first pulley (42) rotating about the third axis (34); and a second pulley (44) rotating about the second axis (32).

18. A unit as claimed in claim 11, wherein said second path (P2) is an endless annular path intersecting the first path at two points (A, B).

19. A unit as claimed in claim 18, wherein a store (21) of labels (2), a cutting blade (50) and a gumming nozzle (51) are located in succession along said second path (P2).

20. A unit as claimed in claim 19, wherein said blade (50) and said nozzle (51) are fixed with respect to said second path (P2).

21. A method of applying labels to packets, in particular packets of cigarettes, traveling in a given direction (D1) along a first path (P1) with a given spacing (P) and arranged a given distance (I) apart; the method comprising feeding a gripping head (33) along a second path (P2), applying a said label (2) to a first face (9) of said packet (3), and inserting said gripping head (33) between one packet (3) and the adjacent following packet (3) to apply said label (2) along said first face (9); said first face (9) being perpendicular to said given direction (D1); said second path (P2) being an annular path intersecting the first path (P1) at two points (A, B).

22. A method as claimed in claim 21, wherein said label (2) comprises a central portion (14) which is positioned contacting said first face (9); and at least a first portion (15) which is positioned contacting a second face (10) of the packet (3); said second face (10) being parallel to said given direction (D1); and the method providing for folding said first portion (15) by means of a fixed first folding device (27) located along the first path (P1).

23. A method as claimed in claim 22, wherein said label (2) comprises a second portion (16) which is positioned contacting a third face (11) of the packet (3); said third face (11) being parallel to said given direction (D1); and the method providing for folding said second portion (16) by means of a fixed second folding device (28) located along the first path (P1).

24. A method as claimed in any one of claim 21, and comprising rolling the gripping head (33) on said first face (9).

25. A unit for applying labels to packets, in particular packets of cigarettes, traveling in a given direction (D1) along a first path (P1) with a given spacing (P) and arranged a given distance (I) apart; the packets (3) having respective first faces (9) perpendicular to said given direction (D1); the unit comprising at least one gripping head (33) movable along a second path (P2) to apply a said label (2) to a respective packet (3), and at least one movable arm (31) for inserting said gripping head (33) between one packet (3) and the adjacent following packet (3) to apply said label (2) along said first face (9); said second path (P2) being an endless annular path intersecting the first path at two points (A, B).

26. A unit as claimed in claim 25, wherein said label (2) comprises a central portion (14) which adheres to said first face (9); and at least a first portion (15) which adheres to a second face (10) of the packet (3); said second face (10) being parallel to said given direction (D1); and the unit comprising a fixed first folding device (27) located along said first path (P1) to fold said first portion (15) onto the second face (10).

27. A unit as claimed in claim 26, wherein said label (2) comprises a second portion (16) opposite the first portion (15); the second portion (16) adhering to a third face (11) parallel to the second face (10); and the unit comprising a fixed second folding device (28) located along said first path (P1) to fold said second portion (16) onto said third face (11).

28. A unit as claimed in claims 27, wherein said second folding device (28) is located downstream from said first folding device (27).

29. A unit as claimed in claim 25, wherein a store (21) of labels (2), a cutting blade (50) and a gumming nozzle (51) are located in succession along said second path (P2).

30. A unit as claimed in claim 29, wherein said blade (50) and said nozzle (51) are fixed with respect to said second path (P2).

31. A unit for applying labels to packets, in particular packets of cigarettes, traveling in a given direction (D1) along a first path (P1) with a given spacing (P) and arranged a given distance (I) apart; the packets (3) having respective first-faces (9) perpendicular to said given direction (D1); the unit comprising at least one gripping head (33) movable along a second path (P2) to apply a said label (2) to a respective packet (3) and at least one movable arm (31) for inserting said gripping head (33) between one packet (3) and the adjacent following packet (3) to apply said label (2) along said first face (9); wherein said label (2) comprises a central portion (14) which adheres to said first face (9); and at least a first portion (15) which adheres to a second face (10) of the packet (3); said second face (1) being parallel to said given direction (D1); and the unit comprising a fixed first folding device (27) located along said first path (P1) to fold said first portion (15) onto the second face (10); wherein said label (2) comprises a second portion (16) opposite the first portion (15); the second portion (16) adhering to a third face (11) parallel to the second face (10); and the unit comprising a fixed second folding device (28) located along said path (P1) to fold said second portion (16) onto said third face (11); said second folding device (28) being located downstream from said first folding device (27).

* * * * *